United States Patent [19]

Shang et al.

[11] Patent Number: 4,867,079

[45] Date of Patent: Sep. 19, 1989

[54] COMBUSTOR WITH MULTISTAGE INTERNAL VORTICES

[76] Inventors: Jer Y. Shang, 4524 Andes Dr., Fairfax, Va. 22030; Richard E. Harrington, 114 Beechwood St., Morgantown, W. Va. 26505

[21] Appl. No.: 44,697

[22] Filed: May 1, 1987

[51] Int. Cl.[4] ..... F23D 1/02

[52] U.S. Cl. ..... 110/264; 110/245; 110/347; 431/7; 431/170; 431/186

[58] Field of Search ..... 110/264, 347, 245; 431/186, 189, 7, 170

[56] References Cited

U.S. PATENT DOCUMENTS

| | | | |
|---|---|---|---|
| 1,200,028 | 10/1916 | Roberts | 431/190 |
| 3,286,666 | 11/1966 | Ohlsson | 110/264 |
| 4,060,041 | 11/1977 | Sowards | 110/245 |
| 4,159,000 | 6/1979 | Iwasaki et al. | 110/244 |
| 4,469,050 | 9/1984 | Korenberg | 422/4 |
| 4,715,301 | 12/1987 | Bianca et al. | 110/264 X |
| 4,722,287 | 2/1988 | Anderson et al. | 110/264 X |

FOREIGN PATENT DOCUMENTS

| | | | |
|---|---|---|---|
| 1159120 | 12/1963 | Fed. Rep. of Germany | 110/264 |

OTHER PUBLICATIONS

"Combustion in Swirling Flors: A Review," by N. Syred et al, Combustion and Flame, vol. 23, pp. 143–201 (1974).

*Primary Examiner*—Edward G. Favors

[57] ABSTRACT

A fluidized bed combustor is provided with a multistage arrangement of vortex generators in the freeboard area. The vortex generators are provided by nozzle means which extend into the interior of the freeboard for forming vortices within the freeboard area to enhance the combustion of particulate material entrained in product gases ascending into the freeboard from the fluidized bed. Each of the nozzles are radially inwardly spaced from the combustor walls defining the freeboard to provide for the formation of an essentially vortex-free, vertically extending annulus about the vortices whereby the particulate material centrifuged from the vortices against the inner walls of the combustor is returned through the annulus to the fluidized bed. By adjusting the vortex pattern within the freeboard, a significant portion of the full cross-sectional area of the freeboard except for the peripheral annulus can be contacted with the turbulent vortical flow for removing the particulate material from the gaseous products and also for enhancing the combustion thereof within the freeboard.

8 Claims, 2 Drawing Sheets

COMBUSTOR WITH MULTISTAGE INTERNAL VORTICES

BACKGROUND OF THE INVENTION

The present invention relates generally to the combustion of particulate solid fuel in combustors provided with vortex generating means for increasing the combustion efficiency and residence time of the fuel within the combustor, and more particularly, to a fluidized bed combustor provided with multistage vortex-generating systems in the freeboard which significantly increases the combustion efficiency of fluidized bed combustors.

Fluidized bed combustion systems are becoming of increasing importance in industrial and utility type applications because of their relatively high combustion efficiencies. In a typical fluidized bed, a fluidization zone is provided in which a combustible carbon-containing material and a granular material such as a sulfur scavenger, sand, or the like are fluidized by a stream of combustion supporting medium, usually air, passing through a distributor underlying the bed. The fluidization causes significant and turbulent mixing of the particulates in the air to provide an efficient combustion process. While fluidized bed combustion processes are relatively efficient, several problems or drawbacks are inherent in their use. For example, one of the problems which detracts from the low combustion efficiency is due to the passage of unburned solid particulates from the combustor by being entrained or elutriated in the gaseous products ascending from the fluidized bed.

One of the efforts employed to increase the combustor efficiency and overcome this problem is to provide for the collection and recycling of the unburned particulates by placing various arrays of cyclones or other gas-solid separators externally of the combustor and then returning the particulate material to the fluidized bed. Another such efforts is the use of a higher freeboard or high space above the fluidized bed. Generally, this freeboard in a fluidized bed combustor functions as a settling chamber or zone for the solid particulates elutriated or entrained in the gaseous combustion products emanating from the fluidized bed. The freeboard is also often of a sufficiently high temperature to provide for substantial combustion of unburned carbon-containing solids and combustibles in the gases. Normally, the height of the freeboard in a fluidized bed combustor was required to correspond to the so-called "transported disengaging height (TDH)" which is defined as the height of the freeboard where the concentration of the entrained solid particulates no longer varies with freeboard height. This height of the freeboard needs to be sufficiently high to assure essentially complete combustion of the solid carbon containing particulate material entrained from the fluidized bed.

In providing cost-effective fluidized bed combustors, especially those operating at high fluidization velocities or those of relatively large diameters, the excessive freeboard height required to provide an effective TDH has been found to be unsuitable since it contributes significantly to the high construction and maintenance costs of the fluidized bed combustors.

A recent development in fluidized bed combustion systems has provided a successful approach for decreasing the freeboard height. This promising approach used is a vortiginous fluidized bed combustion arrangement wherein vortex-generating mechanisms in the freeboard area are utilized to increase the turbulence in the freeboard through the formation of vortices in the freeboard. Normally, these vortices are formed by injecting secondary air into the freeboard through tangentially disposed injectors so as to, in effect, create a cyclone to provide centrifugal forces which act upon the entrained solid particulates in the freeboard area for moving the particulates against the inner walls of the combustor defining the freeboard zone. These solid particulates after impinging upon the walls, slide or descend down the wall as in the hopper and dipleg of a cyclone. This cyclone-type mechanism was expected to facilitate the return of the solid particulate material to the fluidized bed to effectively recycle the unburned particulate material, ash, and other solids to the fluidized bed for completing the combustion of the solid carbon-bearing particulate materials much in the same manner as the combustor systems utilizing cyclones disposed externally of the combustor. The vortices generated within the freeboard also increased the residence time of the solid particulates in the freeboard area so as to enhance the combustion of the carbon-containing gases and solids within the freeboard. By using vortex generators in the freeboard, the overall height of the freeboard could be reduced and the cyclone-type mechanism designed externally of the combustor could be eliminated.

While the fluidized bed combustion systems using vortex-forming generators in the freeboard have provided significant contributions to the fluidized bed combustion art, especially with respect to reducing the height of the freeboard, there were still several drawbacks or deficiencies which considerably detracted from their use in fluidized bed combustors. For example, the vortex-generating mechanisms as known in the art provided for the tangential introduction of the high velocity stream or jets of the secondary combustion supporting medium or air into the freeboard area at locations contiguous to the inner wall of the freeboard zone. This technique of introducing the tangential vortex-forming air imposed a substantial diametrical size limitation on the combustor in that these tangentially introduced jets of air could only form vortices of relatively large diameters in the freeboard. The momentum imparted by the tangentially-induced air streams in a freeboard is limited by the size of the vortex so that in freeboards of relatively large diametrical cross-sections a centrally located volume or eye of the vortex is relatively static or dormant except for ascending gas-particle movement from the fluidized bed since this volume is not influenced by the vortex. This static or vortex-free area within the vertical central region of the freeboard becomes increasingly undesirable with increasing size due to the fact that greater portions of the gaseous and solid particulate material ascending from the fluidized bed can readily escape from the freeboard through the discharge stack at the top of the combustor. The size or diameter of this vortex-free area within the center of the vortex is influenced by the orientation and the velocity of the air streams introduced tangentially to form the vortex.

Another drawback in previously known vortex generator mechanisms is due to the orientation of the vortex generators within the freeboard area in that the tangentially oriented nozzles utilized to provide the jets of the vortex-forming fluid have the outlets thereof essentially flush, if not flush, with the inner walls of the combustor defining the freeboard. This position of these nozzles creates a high velocity stream the vortex-forming air along or closely contiguous to the wall area where the nozzle outlets are located. This high velocity stream of air in turn contacts and entrains a considerable portion of the solid particulates that have been previously driven to the wall by the centrifugal force from vortices generated at higher levels in the freeboard. The net effect of this "reentrainment" condition is that many sections of solid recycling loops of different particle densities will be formed. The residence time for each size range of these recaptured solid particulates is not proportional to the size range of the particulates in the freeboard and thereby presents an unsatisfactory condition in the freeboard.

Still another problem with respect to these nozzles being disposed at locations flush or nearly flush with the inner wall of the combustor section defining the vapor space or freeboard is that the high velocity streams of gas carrying the solid particulates captured from the wall tend to erode the inner wall of the combustor at an excessively high rate. Efforts to overcome this severe erosion problem include the use of various vertically oriented flanges or shoulders for interrupting vortex flow along the walls, or the use of expensive refractory materials in the construction of freeboard walls.

In view of the problems associated with the previously known vortex-producing generators, the apparent advantages gained by using the vortex generators have been considerably degraded by the problems attendant with their use.

SUMMARY OF THE INVENTION

Accordingly, it is the primary aim or objective of the present invention to provide a fluidized bed combustor with vortex generating means in the freeboard area which are capable of both overcoming or substantially minimizing the problems attendant with the heretofore utilized vortex generators and substantially increasing the efficiency of the vortex generators in the freeboard area.

In the formation of a vortex utilizing using two or more opposing jet nozzles in a common cross-sectional plane in the freeboard area, the streams from the tangentially disposed nozzles on opposite sides of the freeboard area form a tangent circle within the freeboard area with the size of the tangent circle being a function of the diametrical distance between the discharge ends of the opposing nozzles and the velocity of the air stream discharging from the nozzles. The momentum transfer from the air streams discharging from the nozzles provides the turbulence required for regions of the freeboard adjacent to the tangent circle with the intensity of this turbulence being attenuated as the gas and solids move away from the tangent circle.

Inasmuch as an appropriate air-to-fuel ratio is required to be maintained in the combustion process, the volume of air capable of being utilized for forming the vortex is necessarily limited. Thus, it is not practical to maintain a desirable degree of turbulence in the freeboard when the tangent circle is fixed in size either by design or by tangentially injected air which forms a tangent circle near the inner wall of the freeboard housing.

The present invention provides for the return of the entrained solid particulate material in the freeboard back into the fluidized bed along the walls of the combustor without being objectionably affected or reentrained by the formed vortices or vortex-forming jets disposed at lower levels or stages within the freeboard area. In accordance with the present invention, the opposing nozzles utilized to form each stage of the solid-capturing vortices are circumferentially off-set from one another and tangentially extend in a common clockwise or counterclockwise direction into the freeboard area so that the formation of the vortices and the turbulent areas adjacent thereto are radially inwardly spaced from the side-walls of the combustor to form a relatively calm or vortex-free annulus adjacent to the inner walls of the combustors. With this arrangement, the entrained solid material is driven by centrifugal action of the vortices in the vortex-free annulus for descent by gravity into the fluidized bed without being reentrained by lower vortices or jets. By employing a stacked or multistage arrangement of such vortex generators within the freeboard area, the freeboard can be considerably reduced in height and still function as efficiently as a much more expensive, conventional, and taller fluidized bed combustor using a multiple cyclone train with a solid particulate reinjection system as previously known.

Generally, the present invention is utilized in a combustion system of the fluidized bed type but can be satisfactorily employed in a spouting bed-type combustor. The combustion system comprises a vertically oriented housing containing upper and lower regions. A combustion zone is disposed in the lower region of the housing. Conduit means are utilized for introducing particulate fuel and a stream of combustion supporting medium into the combustion zone where combustion of the fuel occurs. During this combustion, a stream of gaseous combustion products which contain entrained solid particulate matter including unburned carbon-containing solids is generated and ascends into the upper region. Exhaust means extend through the center of the upper end wall of the housing which is at a location vertically separated from the combustion zone by the upper region for receiving and discharging from the housing gaseous combustion products flowing through the upper region from the combustion zone.

Two or more nozzles are utilized for injecting the combustion supported medium into each of several cross-sectional planes in the upper region or freeboard area of the combustor. These nozzles extend into the freeboard and are disposed at circumferentially spaced apart locations in the same cross-sectional plane so as to form each tangent circle or vortex at a selected spaced relationship with respect to the inner walls of the housing for defining an annulus between the formed vortices and the housing walls which enables the return of the solid particulates into the combustion zone of the combustor. The placement of these nozzles may be diametrically opposite one another in the combustor if only two nozzles are used in a single plane. However, if more than two nozzles are used in a single plane, the nozzles will be circumferentially spaced apart from one another at smaller angles with the inner ends or open ends of the nozzles terminating at the same spatial location with respect to the center of the freeboard area so as to form a vortex of the desired cross section. To achieve the generation of vortices of selected sizes within the cross section of the freeboard, the nozzles of each set are selectively moveable radially inwardly or outwardly within the freeboard area so as to provide for the formation of a vortex of a given circumferential size within the freeboard area without deleteriously affecting the desired air-fuel ration in the combustor. The nozzles are also pivotable to vary the tangential angle within the freeboard area so as to cooperate with the radial displacement of the nozzle means for promoting the formation of vortices of the appropriate cross-sectional area.

The utilization of a plurality of vertically spaced apart nozzle sets provides for the formation of several stages of vortices within the freeboard area. In accordance with the present invention, these vortices may be of different circumferences at each stage so as to significantly minimize the size of the central vortex-free volume and thereby effectively sweep the particulate material from the freeboard area and return the particulates material to the combustor in a manner much more efficiently than theretofore practiced.

Other and further objects of the invention will become obvious upon an understanding of the illustrative apparatus and method about to be described or will be indicated in the appended claims and various advantages not referred to herein will occur to one skilled in the art upon employment of the invention and practice.

Figure 1:
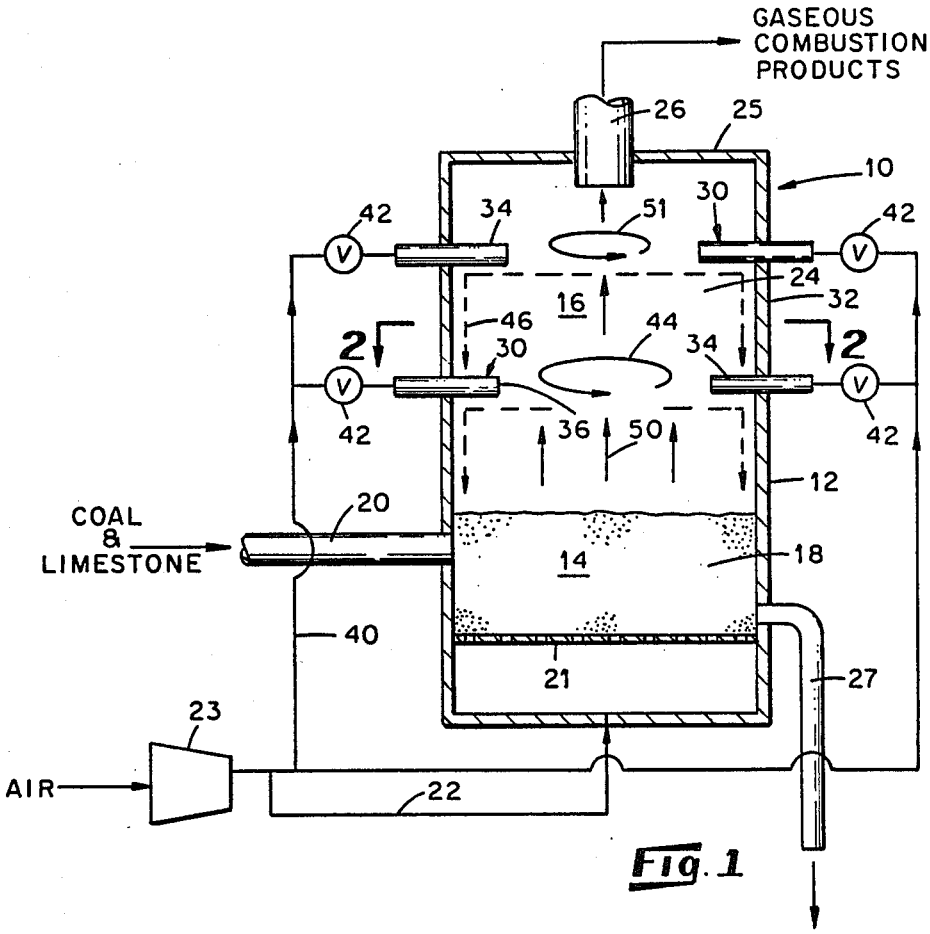
FIG. 1 is a sectional view of a fluidized bed combustor incorporating the multistage vortex-generating mechanism of the present invention.

Preferred embodiments of the invention have been chosen for the purpose of illustration and description. These preferred embodiments illustrated are not intended to be exhaustive or to limit the invention to the precise forms disclosed. They are chosen and described in order to best explain the principals of the invention and their application to practical use to thereby enable others skilled in the art to best utilize the invention and various embodiments and modifications as are best adapted to the particular use contemplated.

DETAILED DESCRIPTION OF THE INVENTION

With reference to the accompanying drawings, the fluidized bed combustor incorporating the vortex-producing system of the present invention is generally shown at 10. The combustor comprises a vertically oriented housing 12 having a lower region 14, and an upper region 16. The lower region 14 in the housing 12 forms the fluidized bed 18 portion of the combustor where a solid carbon-containing material is burned in the presence of a gaseous fluidizing and combustion-supporting medium, e.g., air, to provide gaseous combustion products. Coal, refuse, oil shale, or any suitable combustible carbon-containing material in solid particulate form is introduced into the fluidized bed 18 through conduit 20 from a suitable source (not shown). A particulate material in the form of a sulfur scavenger such as calcium carbonate, dolomite, or the like when coal or oil shale is being used is also introduced into the fluidized bed along with the fuel or separately. In instances where other carbon-containing solids such as refuse are being combusted, a granular material such as sand or the like may be introduced into the fluidized bed in order to maintain the bed 18 in a fluidized state. A distributor 21 is disposed near the lower end of the fluidized bed 18 to support the particulates in the fluidized bed and to distribute a primary stream of the fluidizing and combustion supporting air as is well known in the fluidized bed combustion art. This air is conveyed into the combustor 12 through a conduit 22 coupled to a suitable blower or compressor 23.

The gaseous combustion products provided by the combustion of the coal or other carbon-containing materials within the fluidized bed 18 forms an ascending flow of gaseous combustion products which contain entrained solid material such as calcium carbonate, ash, sand, unburned carbon-containing solids, and the like. These combustion products ascend into the upper region 16 of the combustor which defines a freeboard 24 where further combustion of combustibles in the gases and unburned carbon-containing solids takes place.

The quantity of particulate material entrained in the product gases ascending into the freeboard 24 from the fluidized bed 18 is a function of the velocity, solid particle distribution, and volume of the gas flow through the fluidized bed. Thus, by maintaining maximum solid saturation in the ascending gas flow, the efficiency of the combustion process is effectively increased by recirculating particulate material in the freeboard back to the fluidized bed by utilizing the multistage vortex-generating system of the present invention.

Figure 4:
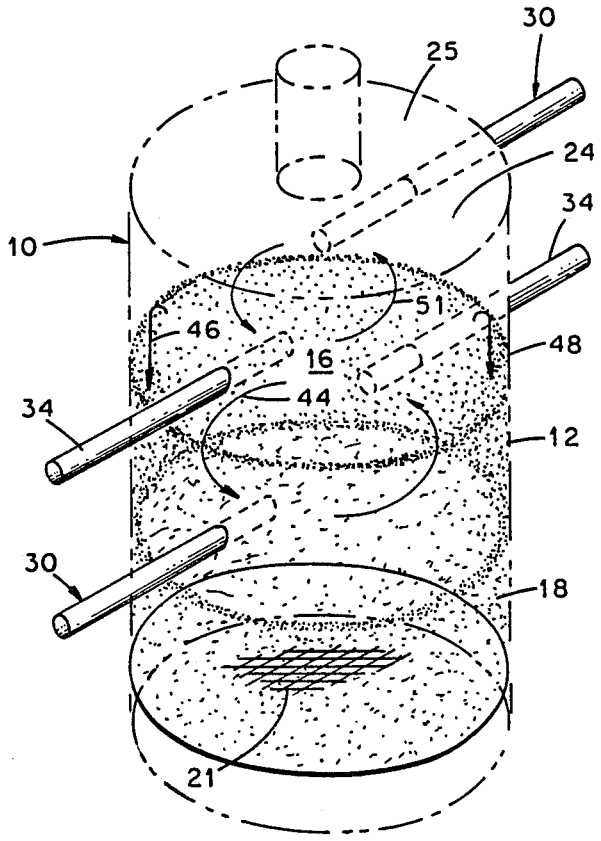
FIG. 4 is a somewhat schematic view generally showing the various flow patterns of the solid particulate material within a fluidized bed when the material is encountered by several stages of vortices produced in accordance with the present invention.

At the top or uppermost end 25 of the housing 12, there is provided an exhaust conduit 26 for discharging the flue gas from the combustor. This flue gas may be used in a boiler or any other heat requiring mechanism. The exhaust conduit 26 is centrally disposed along the longitudinal axis or at the vertical center of the combustor as shown in FIGS. 1 and 4. As shown, the lower end of this centrally disposed conduit 26 extends into the freeboard 24 to provide with the freeboard walls a cyclone-type construction which helps prevent solid particle escape from the freeboard through the exhaust conduit 26. On the other hand, solid waste including ash, expended limestone, and the like is discharged from the fluidized bed 18 through a suitably placed conduit 27 as is known in the art.

The fluidized bed combustor described and shown herein is of an annular or open cylindrical configuration, but it is to be understood that the vortex-generating principles provided by the present invention can be satisfactorily employed in combustors of other shapes such as square or rectangular.

Figure 2:
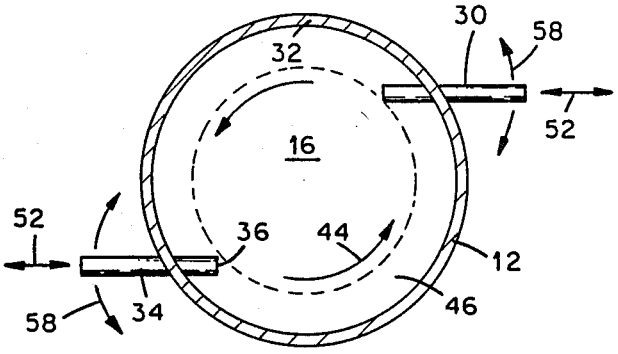
FIG. 2 is a plan view taken generally along lines 2—2 of FIG. 1 showing positional relationships of the vortex-generating nozzle means as well as the configuration of a vortex formed within the combustor at a location spaced from the inner walls of the combustor housing.
Figure 3:
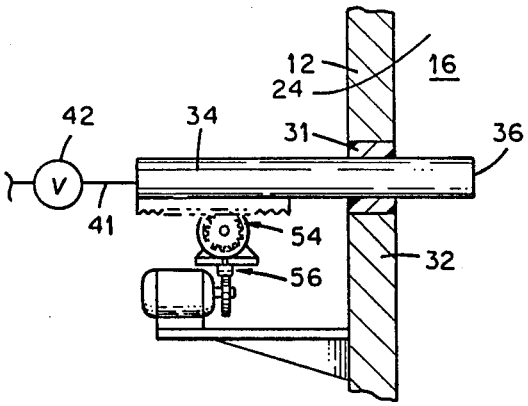
FIG. 3 is an enlarged sectional view of a typical nozzle which may be utilized for producing a vortex within the freeboard of the combustor of FIG. 1 along with details of a nozzle positioning mechanism for radially and/or tangentially moving the nozzle.

In accordance with the present invention, the vortices are provided in the upper region 16 by creating several stages of tangent circles of turbulent, revolving gases for increasing the mixing of the particulate material and the gases so as to effect combustion of various combustible vapors within the product gases as well as the solid carbon-containing particulates carried by the product gases into the freeboard area 24 of the fluidized bed combustor. The vortex generators of the present invention are generally shown at 30 projecting through suitably sealed openings 31 in the vertical walls 32 of the combustor in the form of elongated cylindrical nozzles 34. These nozzles 34 extend horizonally into the vertically oriented housing 12 along a cross-sectional plane perpendicular to the vertical center of the combustor 10. As shown in FIGS. 1 and 3, a plurality of nozzles 34 are placed at vertically spaced apart locations for providing staged vortex generation within the freeboard 24 of the combustor 10 so as to provide the desired centrificial flow for effecting efficient combustion of carbon-containing materials within the freeboard and the separation of the solid particulates from product gases. At each vortex level or stage on a common cross-sectional plane of the freeboard area, at least two of the nozzles 34 are disposed at circumferentially spaced apart locations. As shown in FIGS. 1, 2, and 4, the two nozzles 34 are disposed at diametrically opposed location in the freeboard 24 and extend into the interior of the freeboard 24 with the terminal open end 36 of the nozzle 34 positioned at a location inwardly spaced from the innerwalls 32 of the furnace. These nozzles 34 in each stage are off-set from one another in the same cross-sectional plane and are tangentially disposed in either a clockwise or counterclockwise direction with respect to the vertical center of the freeboard so that air discharging from the ends 36 of the nozzles 34 will form a tangent circle within the confines of the nozzles 34, the cross-sectional plane in which the nozzles 34 are disposed. This tangentially discharge of air is provided by diverting a portion (secondary air) of the combustion-supporting air from the blower 23 through conduits 40 containing flow control valves 42 into the freeboard area via the nozzles 30. The velocity of the air injected from the nozzles should be sufficient to provide a Swirl number of at least about 0.6 and a Reynolds number of at least about 18,000 to form vortices of sufficient turbulence and diameters in the freeboard 24 for achieving the desired combustion of the particles and gases as well as the centrifugal separation of solids from the vortices. The velocity of the air being discharged through the terminal ends 36 of the nozzles 30 should be sufficient to establish a vortex as shown by the arrows 44 in FIGS. 1 and 2 within the interior of the freeboard area. This vortex 44 established by the air flow through the radially inwardly positioned nozzles defines an annulus as generally indicated by the arrow 46 between the peripheral sides of the vortex 44 and inner walls 32 of the housing 12. This annulus 46 is relatively calm or stagnant as compared to the turbulent area provided by the vortex 44 so that the solid particulate material 48 centrifuged from the vortex 44 against the side walls 32 descends along the side walls 32 back into the fluidized bed 18 for refluidization. This constant recycling of the solid particulate material assures effective combustion of the carbon-containing material and sulfur capture.

In accordance with the present invention, the position of the terminal end 36 of each nozzle 34 is selectively adjustable within the freeboard so that vortices of selected diameters may be generated within the freeboard. For example, as shown in FIG. 1, the entrained particulate material as indicated generally by the arrows 50 ascends along with the gaseous products into the freeboard 24 where the particulate material encounters a first vortex 44. This vortex centrifuges a considerable portion of the particulate material in the gases to the sidewall 32 of the combustor for return to the fluidized bed 18. The solid material ascending through the first vortex 44 encounters a second vortex 51 where additional solid particulate material in the ascending gases is removed by the centrifuging effect of the vortex 51. This multistage arrangement of vortices in the freeboard provides for efficient combustion and the removal of the solid particulates from the ascending product gases. Any suitable number of stages of the vortices may be utilized; thus, while only two stages are shown in FIGS. 1 and 4, it will appear clear that the freeboard may be provided with as many stages or levels of vortex generators as desired for providing the desired solid particle removal and combustion efficiency.

The vortices generated at different stages may be of different diameters. For example, as best shown in FIGS. 1 and 4, the nozzles ends 36 in the first or lower stage are spaced from the inner walls 32 of the housing 12 a relatively short distance so as to provide a vortex 44 of a relatively large diameter. This vortex 44 effectively removes the particulate material from essentially the full cross-sectional area of the freeboard 24 except for the annulus 46 and drives the particulate material against the walls for descent through the annulus 46 into the fluidized bed. However, by using a relatively large diameter of vortex at the first stage, the central region or "eye" of the vortex is not effected by the vortex so that the entrained material in the gases passing through the eye ascends towards the exhaust relatively unimpeded. In order to capture this ascending particulate material and recirculate it for increased combustion efficiency, the second level or stage of vortex-generating nozzles 34 are positioned radially inwardly from nozzles 34 providing the first vortex so as to provide a vortex 51 of smaller diameter. This smaller diameter vortex 51 has a smaller eye area and, thus, captures a significant percentage of the ascending particulate material missed by the first vortex 44 and drives it against the housing wall for return in a relatively unimpeded manner along the annulus 46 into the fluidized bed 18. Thus, the selective positioning of the nozzles 30 within various combustors of different diametrical sizes allows for the combustion to occur in accordance with a desired and changeable operation.

As generally shown in FIGS. 2 and 3, the position of the nozzles 30 can be radially adjusted along a cross-sectional plane in the freeboard 24 as indicated by the arrows 52 by a suitable drive mechanism such as a simple rack and pinion drive generally shown at 54. A similar type gear drive shown at 56 may be used to change the tangential angle of the nozzle 34 within the housing 12 as indicated by the arrows 58. The cooperative operation of these gear drives 54 and 56 provide for the selected positioning of the nozzles 30 within the freeboard area of the combustor 10 to provide for the formation of a vortex of any desired size. These gear drives shown are merely illustrative of any suitable mechanism which can be utilized to control the position of the nozzles 30 within the freeboard.

In a typical operation of a fluidized combustor 10 provided with the vortex-generating system of the present invention and using coal as the combustible material, the particulates of coal and limestone or dolomite are introduced into the fluidized bed 18 through conduit 20. A primary stream of the combustion supporting medium, i.e., air, is introduced into the lower end of the fluidized bed 18 and distributed through the grate 21 for forming the fluidized bed 18. The combustion of the coal within the fluidized bed 18 provides gaseous combustion products which ascend into the freeboard or upper region 16 of the combustor 10. These gaseous combustion products contain a considerable quantity of solid particulate material including ash, limestone, and unburned coal. The multistages of nozzles 30 extending into the freeboard 24 are supplied with a stream of secondary air through conduit 40 to provide the formation of vortices within the freeboard 24. The flow of the air into the freeboard through any of the nozzles 30 is controlled by valve 42 so as to facilitate the formation of vortices of desired diametrical sizes. The vortices capture the particulate material in the gaseous products and drives it in a manner of a centrifuge towards the inner walls 32 of the housing 12 defining the freeboard 24. This particulate material contacts the housing wall and then descends in the annulus 46 into the fluidized bed 18 where the particulate material is again fluidized, combusted, and subsequently reentrained in the stream of ascending combustion products. The turbulent flow established by the vortices effects combustion of the carbon-containing material and vapors in the gases within the freeboard area with the greater turbulence providing the greater combustion of these combustibles.

It will be seen that employing the present invention in fluidized bed and spouting bed combustors that a significant turbulent area can be established within the combustor for enhancing the combustion of the solid carbon-containing particulate material and combustible vapors within the product gases. The annulus formed near the sidewalls of the combustor provides a mechanism by which unburned particulate material, ash, limestone, sand, dolomite, and any other solid material entrained in the ascending gases may be returned to the fluidized bed without encountering the problems associated with errosion or bridging or plugging in the associated cyclone dipleg as experienced in previously known fluidized-bed combustors and the nonuniform distribution of particulate material within the vortices as heretofore encountered. Further, by deploying the nozzles in selected positions within the freeboard, vortices of various diameters may be established so as to maximize the capture of the particulate material ascending in and near the vertical center of the freeboard which has heretofor been a stagnant area with respect to vortex formation.

We claim:

1. A combustor comprising a vertically oriented housing having walls defining lower and upper regions, a combustion zone in the lower region of the housing, means for introducing particulate fuel into the combustion zone, means for introducing a primary stream of gaseous combustion-supporting medium into the combustion zone for reacting with the fuel and thereby providing a stream of ascending gaseous combustion products containing entrained solid particulate material, exhaust passageway means extending through the housing at a central location vertically separated from said combustion zone by said upper region for receiving and discharging from said housing gaseous combustion products ascending through said upper region, vortex-generating means comprising a plurality of elongated nozzle means projecting into the upper region of said housing with each of said plurality of nozzle means extending away from the walls of the housing and into said upper region along a plane perpendicular to the walls of said housing and at an angle tangent to the vertical center of the housing, at least two of said plurality of nozzle means being disposed at spaced apart locations in a common cross-sectional plane in said upper region, and means for conveying a secondary stream of combustion-supporting medium through an open end of each of said plurality of nozzle means into said upper region only at a location inwardly spaced from said walls for forming a vortex of the combustion-supporting medium and the gaseous products of combustion including said solid particulate material contacted thereby within the upper region in said cross-sectional plane and with said vortex being spaced from said walls of the housing to define an essentially vortex-free annulus between said walls of the housing and (about) said vortex within said upper region so that the solid particulate matter contacted by said vortex and driven from the vortex towards said walls of the housing enters said annulus and descends from said upper region through said annulus to said combustion zone.

2. A combustor as claimed in claim 1, wherein said plurality of nozzles means includes at least two additional nozzle means disposed in said upper region at spaced apart locations in a common cross-sectional plane vertically spaced from the first mentioned common cross-sectional plane.

3. A combustor as claimed in claim 2, wherein moving means are coupled to each of said plurality of nozzle means for radially positioning each of said nozzle means in said upper region along each of said common cross-sectional planes to selectively vary the diameter of each vortex formed in said upper region.

4. A combustor as claimed in claim 1, wherein said at least two nozzle means consists of two elongated nozzles diametrically opposed from one another for forming said vortex therebetween.

5. A combustor as claimed in claim 1, wherein said combustor is a fluidized bed combustor, a fluidized bed forms said combustion zone, and wherein said upper region defines a freeboard.

6. A method of operating a fluidized-bed combustor comprising the steps of establishing of fluidized bed of solid particulate material including combustible material and a combustion-supporting and fluidizing medium in a lower portion of a vertically oriented housing, providing a vapor space in a portion of said housing above said fluidized bed for receiving a stream of gaseous combustion products including entrained solid particulates ascending from said fluidized bed, and tangentially injecting at least two streams of combustion-supporting medium into said vapor space in a common cross-sectional plane in said vapor space for forming a vortex of combustion-supporting medium and said gaseous combustion products in said plane with said injecting occurring only at a location inwardly spaced from walls defining said housing to provide an essentially vortex-free annulus about said vortex for receiving particulate material driven from said vortex by the centrifuging action of the vortex upon the solid particulates and the return of the particulate material to said fluidized bed.

7. The method of operating a fluidized-bed combustor as claimed in claim 1, including the additional steps of tangentially injecting at least two streams of combustion-supporting medium into said vapor space in another common cross-sectional plane vertically spaced from the first mentioned common cross-sectional plane for forming a further vortex of combustion-supporting medium and said gaseous combustion products at a location spaced from said walls to provide a further annulus about said further vortex and define a vertically extending annulus with the first mentioned annulus.

8. The method claimed in claim 6, including the additional step of injecting the combustion-supporting medium into said vapor space at a selected location spaced from said walls for providing said vortex with a selected diameter.

* * * * *